US011118421B2

(12) United States Patent
Machocki

(10) Patent No.: US 11,118,421 B2
(45) Date of Patent: Sep. 14, 2021

(54) BOREHOLE SEALING DEVICE

(71) Applicant: Saudi Arabian Oil Company, Dhahran (SA)

(72) Inventor: Krzysztof Karol Machocki, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 2 days.

(21) Appl. No.: 16/741,861

(22) Filed: Jan. 14, 2020

(65) Prior Publication Data

US 2021/0215016 A1 Jul. 15, 2021

(51) Int. Cl.

| | |
|---|---|
| ***E21B 33/12*** | (2006.01) |
| ***E21B 33/128*** | (2006.01) |
| ***E21B 33/06*** | (2006.01) |
| ***E21B 47/08*** | (2012.01) |

(52) U.S. Cl.

CPC ..... *E21B 33/128* (2013.01); *E21B 33/06* (2013.01); *E21B 47/08* (2013.01)

(58) Field of Classification Search

CPC ..... E21B 33/06; E21B 33/128; E21B 47/08
See application file for complete search history.

(56) References Cited

U.S. PATENT DOCUMENTS

| | | | |
|---|---|---|---|
| 6,244,359 | B1 | 6/2001 | Bridges et al. |
| 8,631,874 | B2 | 1/2014 | Kozicz et al. |
| 9,175,542 | B2 | 11/2015 | Bailey et al. |
| 9,376,870 | B2 | 6/2016 | Orbell et al. |
| 9,845,653 | B2 | 12/2017 | Hannegan et al. |
| 9,856,713 | B2 | 1/2018 | Tarique et al. |
| 10,012,044 | B2 | 7/2018 | Leba et al. |
| 10,087,701 | B2 | 10/2018 | Bailey et al. |
| 10,138,710 | B2 | 11/2018 | Noske |
| 2005/0241833 | A1 | 11/2005 | Bailey et al. |
| 2009/0101411 | A1* | 4/2009 | Hannegan ..... E21B 7/02 175/25 |
| 2010/0101776 | A1* | 4/2010 | Atkins ..... E21B 33/1208 166/121 |
| 2014/0027129 | A1* | 1/2014 | Hannegan ..... E21B 33/06 166/387 |

(Continued)

FOREIGN PATENT DOCUMENTS

| | | |
|---|---|---|
| AU | 2013280514 B2 | 9/2016 |
| EP | 1933068 | 8/2008 |

(Continued)

OTHER PUBLICATIONS

International Search Report for PCT/IB2020/051192, 5 pages (dated Sep. 30, 2020).

(Continued)

*Primary Examiner* — Christopher J Sebesta
(74) *Attorney, Agent, or Firm* — Charles E Lyon; Mehdi Haiizadegan; Peter A Flynn

(57) ABSTRACT

Apparatuses, systems, and methods for sealing Rotating Control Devices (RCD) may include one or more guides that track the diameter of a pipe and pre-expands an RCD seal when larger diameter pipes or portions of pipes are approaching the seal. The RCD seal may reduce the stress between sealing faces and the larger pipe diameter, thereby decreasing the likelihood of a damaged or blown seal.

22 Claims, 8 Drawing Sheets

(56) References Cited

U.S. PATENT DOCUMENTS

| | | | | |
|---|---|---|---|---|
| 2014/0060811 | A1* | 3/2014 | Mazyar | E21B 10/22 166/118 |
| 2015/0211319 | A1 | 7/2015 | Hannegan et al. | |
| 2015/0315845 | A1 | 11/2015 | Chambers et al. | |
| 2016/0047187 | A1* | 2/2016 | Dirksen | E21B 33/064 175/6 |
| 2017/0159383 | A1* | 6/2017 | Orban | E21B 19/165 |
| 2018/0245444 | A1* | 8/2018 | Hardt | E21B 44/00 |
| 2018/0274323 | A1* | 9/2018 | Arefi | E21B 47/08 |
| 2018/0328134 | A1* | 11/2018 | Peer | E21B 33/072 |
| 2018/0355683 | A1 | 12/2018 | Eriksen | |
| 2019/0093445 | A1* | 3/2019 | Kulkarni | E21B 34/02 |
| 2019/0195032 | A1* | 6/2019 | Clark | E21B 17/01 |
| 2020/0115987 | A1* | 4/2020 | Rome | A61P 29/00 |

FOREIGN PATENT DOCUMENTS

| | | | |
|---|---|---|---|
| WO | WO-2012/138333 | A1 | 10/2012 |
| WO | WO-2019118394 | A1 | 6/2019 |

OTHER PUBLICATIONS

Written Opinion for PCT/IB2020/051192, 9 pages (dated Sep. 30, 2020).

* cited by examiner

BOREHOLE SEALING DEVICE

FIELD

The subject matter described herein relates to apparatuses, systems, and methods for sealing boreholes at drilling sites.

BACKGROUND

Modern Managed Pressure Drilling (MPD) worksites may employ one or more Rotating Control Devices (RCD) to contain and divert drilling fluid within a borehole annulus, and to create a pressurized barrier with the aid of an RCD seal, which constantly engages the outside diameter of a drill pipe. A pressurized barrier is required to apply a pressure to the fluid on the annular side of the drill pipe, and eventually to control the pressure at the bottom of the borehole.

Many current RCD seal designs are prone to failure, leading to fluid leaks at the surface of the borehole, and loss of back pressure applied by the MPD choke. RCD failures may occur for a variety of reasons. In some cases, failures are related to situations where a different diameter of pipe (or a pipe with a varying diameter) is passing through the seal. One typical scenario occurs when drill pipe tool joints are passing through the seal. The drill pipe tool joints are typically larger diameter than the drill pipe outer diameter. Typically, a 5-inch drill pipe outer diameter may have a tool joint with a 7 to 8-inch outer diameter. This change in diameter in some circumstances can be rapid, with a high degree angle (up to 90 degrees) or "lip."

In many instances, these tool joints and connecting collars may have outer surfaces, leading edges, and trailing edges that include sharp edges or rapid changes in diameter. The consequences of seal failure may include surface leaks, loss of bottom hole pressure (which might then lead to borehole instability), as well as hydrocarbon influx and blow-outs. Usually such failures of the RCD seal are detected at the surface and corrective actions are taken. Corrective action may include: pulling the drill string out to a safe area, closing down the blowout preventer (BOP), and replacing the broken RCD seals, which can lead to time delays, high equipment costs, and productivity losses.

SUMMARY OF THE INVENTION

The present disclosed embodiments include apparatuses, systems, and methods for sealing Rotating Control Devices (RCD). An RCD seal according to the present embodiments tracks the diameter of a pipe and pre-expands the seal when larger diameter pipes or portions of pipes are approaching. The RCD seal of the present embodiments may also reduce the stress between sealing faces and the larger pipe diameter, thereby decreasing the likelihood of a damaged or blown seal.

In one aspect of the present invention, a seal assembly includes: a rotating control device (RCD) seal including a sealing face for interfacing with a drill string, the sealing face concavely contoured, extending longitudinally, and sealing an annulus of a borehole; and a seal guide coupled to the RCD seal and extending both longitudinally above and longitudinally below the sealing face. The seal guide causes the RCD seal to move radially inward and/or radially outward, upon making contact with one or more portions of the drill string that includes a changing outer diameter.

In some embodiments, one or more portions of the drill string includes a leading edge of a drill pipe tool joint, or a trailing edge of a drill pipe tool joint.

In some embodiments, the assembly includes a guide seal retainer coupling the seal guide to the RCD seal.

In some embodiments, the seal guide includes: a guide middle portion oriented in a longitudinal direction; a guide top portion extending longitudinally upward from the guide middle portion; and a guide bottom portion extending longitudinally downward from the guide middle portion.

In some embodiments, the guide top portion is oriented at an angle from about 19 degrees to about 39 degrees relative to the longitudinal direction, and the guide bottom portion is oriented at an angle from about 22 degrees to about 42 degrees relative to the longitudinal direction.

In some embodiments, the guide middle portion is longer than each of the guide top portion and the guide bottom portion.

In some embodiments, the guide top portion and/or the guide bottom portion includes a contoured face for interfacing with the drill string.

In some embodiments, the guide top portion and/or the guide bottom portion includes a rounded edge defining a transition between the contoured face and a radially outer portion of the guide top portion and/or the guide bottom portion.

In some embodiments, the guide top portion and/or the guide bottom portion includes a lip for interfacing with a leading edge and/or a trailing edge of the drill string.

In some embodiments, the lip is oriented at an angle from about 10 degrees to about 30 degrees relative to the longitudinal direction.

In some embodiments, the assembly includes a hard coating disposed on the sealing face of the RCD seal.

In some embodiments, the RCD seal includes multiple segments circumferentially spaced around an outer diameter of the drill string.

In some embodiments, the assembly includes at least six (6) seal guides circumferentially spaced within the RCD seal.

In some embodiments, the seal guide further includes: at least one upper guide extending longitudinally above the sealing face; and at least one lower guide extending longitudinally below the sealing face.

In some embodiments, the guide seal retainer includes an upper guide seal retainer and a lower guide seal retainer, where each of the upper guide seal retainer and the lower guide seal retainer includes a flexible, ring-shaped retainer circumferentially disposed within an interior of the RCD seal, and also disposed through the seal guide.

In some embodiments, the guide top portion is oriented at an angle from about 19 degrees to about 39 degrees relative to the longitudinal direction, the guide bottom portion is oriented at an angle from about 22 degrees to about 42 degrees relative to the longitudinal direction, the guide middle portion is longer than each of the guide top portion and the guide bottom portion, and the guide top portion and/or the guide bottom portion includes a contoured face for interfacing with the drill string.

In another aspect of the present invention, a rotating control device (RCD) includes an upper seal assembly including: a rotating control device (RCD) seal comprising sealing face for interfacing with a drill string, the sealing face concavely contoured and extending longitudinally, the sealing face sealing an annulus of a borehole; and a seal guide coupled to the RCD seal, the seal guide extending both longitudinally above and longitudinally below the sealing face. The seal guide causes the RCD seal to move radially outward upon contacting a portion of the drill string that includes a widening outer diameter. The seal guide causes the RCD seal to move radially inwardly upon contacting a portion of the drill string that includes a narrowing outer diameter.

In some embodiments, the device includes: a lower seal assembly disposed longitudinally below the upper seal assembly.

In some embodiments, the device includes: an RCD housing for housing the upper seal assembly and the lower seal assembly; an annulus defined by a space radially outward of the drill string and radially inward of the RCD housing; and a pipe connection fluidly connecting the annulus to an RCD buffer manifold.

In another aspect of the present invention, a seal assembly includes: a rotating control device (RCD) housing including a hinge; an RCD seal segment disposed within the RCD housing and rotatably coupled to the hinge, the RCD seal segment including a sealing face for interfacing with a drill string; and a seal guide coupled to the RCD seal segment. The seal guide and the RCD seal segment rotate about the hinge when the seal guide is contacted by an outer surface of the drill string.

In some embodiments, the outer surface of the drill string includes a drill pipe tool joint leading edge and/or a drill pipe tool joint trailing edge.

In some embodiments, the assembly includes a seal compression spring disposed in the RCD seal segment, the seal compression spring biasing the RCD seal segment against the drill string.

In some embodiments, the seal guide causes the RCD seal to move radially outward upon contacting a portion of the drill string that includes a widening of the drill string outer diameter. The seal guide causes the RCD seal to move radially inward upon contacting a portion of the drill string that includes a narrowing of the drill string outer diameter.

Throughout the description, where an apparatus, systems or embodiments are described as having, including, or comprising specific components, or where methods are described as having, including, or comprising specific steps, it is contemplated that, additionally, there are systems, apparatuses or embodiments of the present invention that consist essentially of, or consist of, the recited components, and that there are methods according to the present invention that consist essentially of, or consist of, the recited processing steps.

It should be understood that the order of steps or order for performing certain action is immaterial as long as the invention remains operable. Moreover, two or more steps or actions may be conducted simultaneously.

The following description is for illustration and exemplification of the disclosure only, and is not intended to limit the invention to the specific embodiments described.

The mention herein of any publication, for example, in the Background section, is not an admission that the publication serves as prior art with respect to any of the present claims. The Background section is presented for purposes of clarity and is not meant as a description of prior art with respect to any claim.

BRIEF DESCRIPTION OF THE DRAWINGS

A full and enabling disclosure of the present disclosed embodiments, including the best mode thereof, directed to one of ordinary skill in the art, is set forth in the specification, which refers to the appended figures, in which.

DESCRIPTION OF CERTAIN EMBODIMENTS OF THE INVENTION

Figure 1:
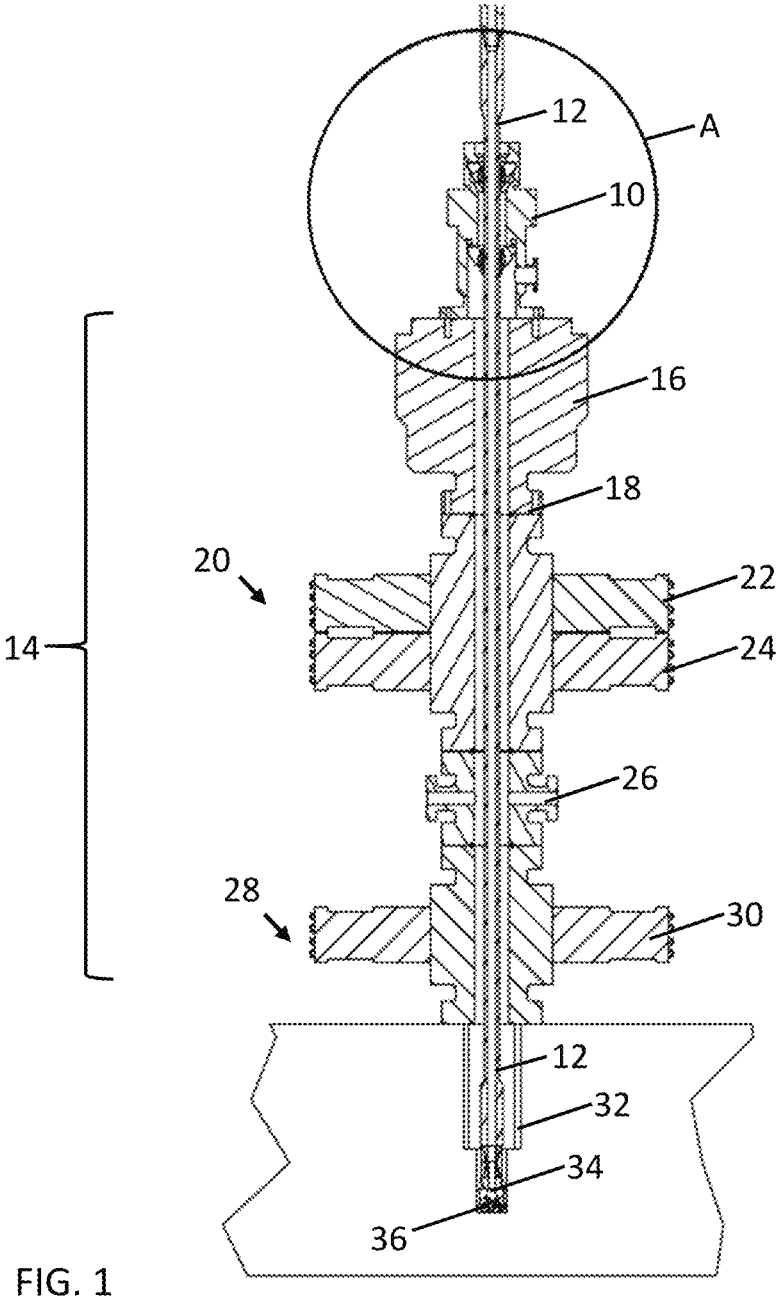
FIG. 1 illustrates a rotating control device (RCD) mounted to the top of a blowout preventer (BOP) stack, in accordance with aspects of the present disclosed embodiments.

Reference will now be made in detail to the present disclosed embodiments, one or more examples of which are illustrated in the accompanying drawings. The detailed description uses numerical and/or letter designations to refer to features in the drawings. Like or similar designations in the drawings and description have been used to refer to like or similar parts of the present embodiments.

The present disclosed embodiments include apparatuses, systems, and methods for reducing the rate of failures of Rotating Control Device (RCD) seals. The RCD seal of the present embodiments may be equipped with guides that are capable of tracking the diameter of a pipe and reacting when diameter changes are encountered. Such guides may trail the outer diameter of a pipe, tubular, or other drilling tool used in a Managed Pressure Drilling (MPD) borehole. If a change in diameter is encountered, such guides may pre-open the RCD seals before the sealing edge contacts the larger pipe diameter (or sharp edge) when stepping up to the larger outer diameter. Additionally, such guide may change the stress loading inside the seal, putting more stress on the guides and surfaces thereof, thereby serving to unload the sealing face. Such action may reduce the effect of sharp edges and tong marks that often slice the sealing face of the RCD seal.

FIG. 1 illustrates a rotating control device (RCD) 10 mounted to the top of a blowout preventer (BOP) stack 14. The BOP stack 14 may include an annular BOP 16 disposed up-hole of one or more flanges (or couplings 18), which in turn may be disposed within the BOP stack 14 up-hole of one or more double ram BOPs 20. The double ram BOP 20 may include both a pipe ram 22 for sealing off an annulus of the borehole while a drill string 12 is disposed within the borehole, as well as a blind ram 24, for sealing the borehole when there is no drill string 12 disposed within the borehole. As such, the double ram BOP 20 may be used to seal the borehole or annulus whether or not there is a drill string 12 or drill pipe disposed therein. Disposed downhole of the double ram BOP 20, the BOP stack 14 may include one or more choke lines 26 for diverting fluids from a borehole annulus and for maintaining the borehole pressure within a desired range. Disposed downhole of the one or more choke lines 26, the BOP stack 14 may include one or more single ram BOPs 28 including one or more pipe rams, blind rams, or a shear ram 30, which may be used to shear (that is, cut through) the drill string 12 and seal the borehole. Downhole of the BOP stack 14, a collar 32 may be disposed radially outward of the drill string and up-hole of a drill bit 34 at the downhole portion of the well 36. The present disclosed embodiments may be used in connection with conventional BOP stacks 14, drill strings 12, rotating control devices (RCD) 10, and other equipment used in the oil and gas industries.

Figure 2:
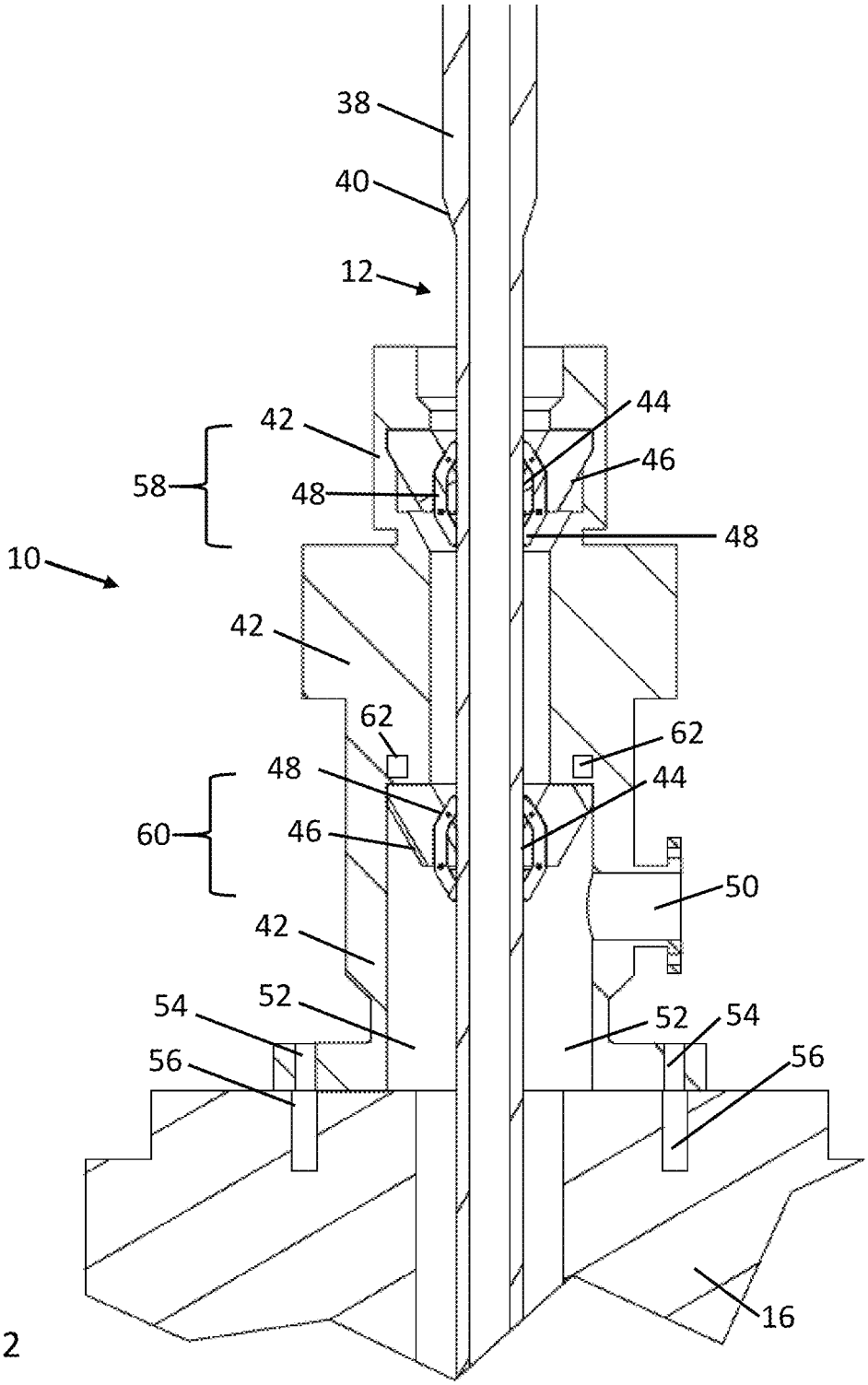
FIG. 2 illustrates a rotating control device (RCD), in accordance with aspects of the present disclosed embodiments.

FIG. 2 illustrates a rotating control device (RCD) 10 according to aspects of the present embodiments. FIG. 2 includes an enlarged view of the portion of the system of FIG. 1 within the circle marked A. A drill string 12 may be disposed within the RCD 10 and may include a drill pipe tool joint 38 including a larger outer diameter than other portions of the drill string 12. The drill string 12 may transition from a larger diameter to a smaller diameter at a tool joint leading edge 40. Disposed at an up-hole end of the RCD 10, an RCD housing 42 may include one or more RCD seals 46 including a sealing face 44, as well as one or more seal guides 48. Each sealing face 44 of the one or more RCD seals 46 may be longitudinally oriented and concavely contoured such that they may interface with the longitudinally oriented drill string 12. One or more springs 82 (shown in FIG. 6) may be disposed in a radially outer wall of the RCD seals 46 such that the RCD seal 46 remains biased against the drill string 12, even as an increasing diameter of the drill string 12 may cause the RCD seal 46 to move radially outward. The RCD seal 46 may be a solitary (monolithic) component. In other embodiments, the RCD seal 46 may include several segments circumferentially arranged around the drill pipe 12 within the RCD housing 42, each segment having at least one seal guide 48 disposed thereon.

Referring still to FIG. 2, the rotating control device (RCD) 10 may include one or more pipe connections 50 connecting to an RCD buffer manifold, as well as an annulus 52 defined by the space radially outward of the drill string 12, and radially inward of the RCD housing 42 interior walls, and through which drill fluid and drill fragments may flow in order to exit the borehole. The one or more pipe connections 50 and the RCD buffer manifold (which may include one or more valves and flow-paths) allow for a transition between the annulus 52 and a surface or downstream managed pressure drilling (MPD) system and components. The RCD 10 may be secured to the annular BOP 16 (that is, the top or up-hole portion of the BOP stack 14) via one or more dowels (or pins 54) in connection with one or more blind holes or pin holes 56 disposed in the top surface of the BOP stack 14 (or annular BOP 16). The one or more dowels or pins 54 may be disposed in a bottom surface of the RCD 10 and may be used to circumferentially align the RCD 10 with the BOP stack 14 (or annular BOP 16), and may also be used to anchor the RCD 10, allowing torque from the RCD 10 to act on the drill string 12 as needed, and vice versa. In some embodiments, instead of dowels or pins 54, the RCD 10 may be secured to the BOP stack 14 (or annular BOP 16) with one or more screws (not shown) in which case the hole 56 may include internal threading (not shown). In other embodiments, the rotational control device (RCD) 10 may not be directly coupled to a BOP stack 14 (or annular BOP 16), and instead may be coupled to one or more adaptors (not shown) which in turn may be coupled to the BOP stack 14 (or annular BOP 16).

Still referring to FIG. 2, the rotating control device (RCD) 10 may include both an upper seal assembly 58 as well as a lower seal assembly 60. Each of the upper and lower seal assemblies 58, 6 may include an RCD seal 46 (including a seal face 44) as well as one or more seal guides 48. Each seal guide 48 may be coupled to the RCD seal 46 and biased against the drill string 12 such that each seal guide 48 remains in contact with the drill string 12 as the drill string 12 both rotates, and moves longitudinally up and down within the borehole. The seal guides 48 extend longitudinally along the drill string 12 such that they interface with the leading edge 40 or trailing edge (not shown) of the drill pipe tool joint 38 prior to the leading edge 40 (or trailing edge) reaching the RCD seal 46. Because the guide seals 48 are coupled to the RCD seals 46, when the seal guides 48 are pushed radially outwardly by coming into contact with the leading edge 40 (or trailing edge), the seal guides 48 also move the RCD seals 46 (or a portion thereof) radially outwardly, thereby serving to pre-open, or pre-close the RCD seals 46. One or more hinges 62 may be disposed within the RCD housing 42 allowing the RCD seals to rotate as needed as they open and close. Because the RCD 10 may include both an upper seal assembly 58 and a lower seal assembly 60, the RCD 10 may provide redundant sealing, and may also ensure that at least one of the upper seal assembly 58 and the lower seal assembly 60 is always closed, even as tool joints 38 and other structures are moving through the RCD seal (that is, since drill pipe tool joints 38 can only pass through the upper and lower seal assemblies 58, 60 one at a time).

Referring still to FIG. 2, the RCD housing 42 may be a standard housing used in conventional managed pressure drilling (MPD) systems. The RCD housing may accommodate double or single rubber elements (that is, dynamic rubber sealing elements at the top and bottom of the RCD 10). The RCD housing 42 may provide a pressurized enclosure between the RCD seals 46 and the drill pipes 12 or tubulars inside the upper and lower seal assemblies 58, 60. In one embodiment, a standard RCD housing 42 may be used in connection with the present embodiments, without needing to be modified. In other embodiments, the RCD housing 42 may require modifications in order to accommodate the seal guides 48.

Figure 3:
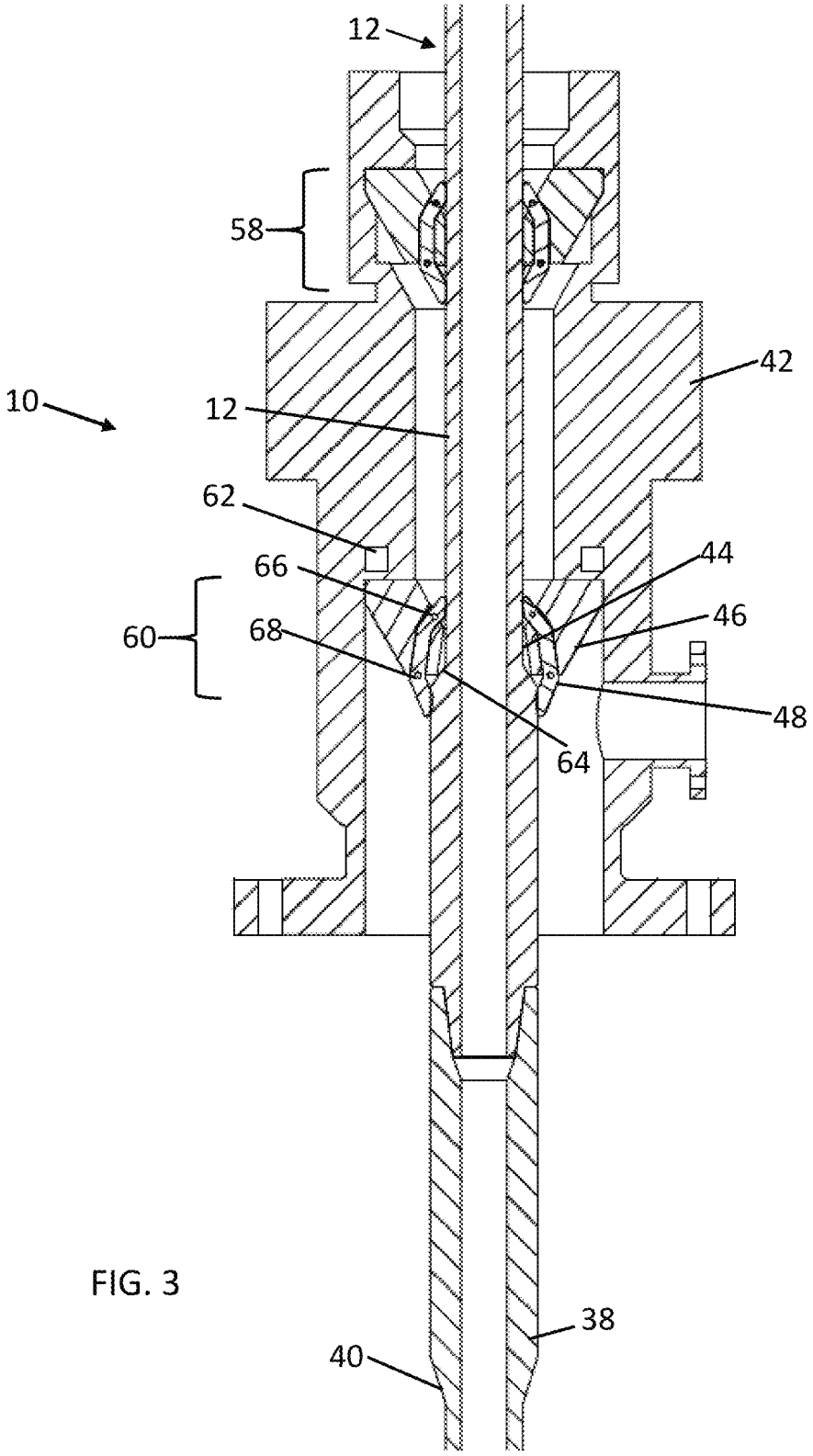
FIG. 3 illustrates a front view of a rotating control device (RCD), in accordance with aspects of the present disclosed embodiments.

FIG. 3 illustrates a front view of a rotating control device (RCD) 10 according to aspects the present embodiments, including a drill string 12 disposed within the RCD housing 42. The drill string 12 may include one or more tool joints 38, as well as one or more leading edges 40 and one or more trailing edges 64 defining the transitions between the larger outer diameters of the tool joints 38 and the smaller outer diameters of other portions of the drill string 12. In the embodiment of FIG. 3, both the leading edge 40 and the trailing edge 64 have passed through the upper seal assembly 58, while only the leading edge 40 has passed through the lower seal assembly 60. The RCD seal 46, sealing face 44, and seal guides 48 of the lower seal assembly 60 are disposed radially outward of the trailing edge 64 of the tool joint 38, while the tool joint 38 passes through the lower seal assembly 60. Upper portions (that is, those portions proximate the up-hole direction) of each of the seal guides 48 and the sealing faces 44 of the lower seal assembly 60 are biased against the smaller outer diameter of the drill string 12. By contrast, lower portions (that is, those portions proximate the downhole direction) of each of the seal guides 48 and the sealing faces 44 of the lower seal assembly 60 are biased against the larger outer diameter of the drill pipe tool joint 38. Each of the seal guides 48 may be coupled to at least one RCD seal via an upper seal guide retainer 66 as well as via a lower seal guide retainer 68.

Referring still to FIG. 3, the upper and lower seal guide retainers 66, 68 may include pins, tacks, axes, dowels, rods, screws, rivets, weld joints, braze joints, magnets, compression joints, locking mechanisms, tongue and groove assemblies, dovetails, tangs and slots, as well as other suitable retainers for coupling the seal guides 48 to the RCD seal 46. In embodiments of the RCD 10 that include both the upper and lower seal guide retainers 66, 68, the seal guides 48 may be coupled to the one or more RCD seals 46 at a fixed orientation such that the seal guides do not rotate relative to the one or more RCD seals 46. Instead, the RCD seals 46 and seal guides 48 may together rotate about the hinges 62 in order to open or close according to whether a leading edge 40 or trailing edge 64 is passing through the respective upper or lower seal assembly 58, 60. In other embodiments, the seal guides 48 may be rotatably coupled to the RCD seals 46 via a single pin, axis, or other bearing such that the seal guides 48 may pivot or rotate about the pin, axis, or bearing relative to the RCD seals 46. In embodiments that employ a single connection point between each seal guide 48 and the one or more RCD seals 46, the RCD seals may pivot about the respective hinge 62, or may translate radially outward, thereby relying on the rotation of the seal guides 48 to continuously maintain contact with the drill string 12, even as the diameter of the drill string 12 is changing due to contact being made with a leading edge 40 or a trailing edge 64.

Still referring to FIG. 3, the drill string 12 may be moving vertically downward or upward through the RCD 10. As such, the seal guides 48 extend both longitudinally above and longitudinally below the sealing face 44 such that the seal guides 48 catch the leading or trailing edge 40, 64 as the drill pipe tool joint 38 moves either upward or downward through the RCD seal 46 (or upper and lower seal assemblies 58, 60).

Figure 4:
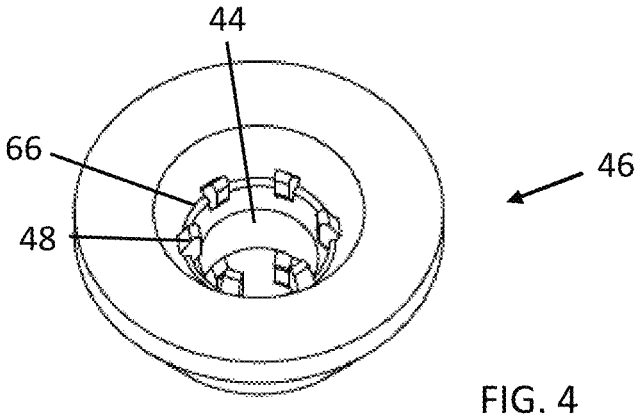
FIG. 4 illustrates a top perspective view of a rotating control device (RCD), in accordance with aspects of the present disclosed embodiments.

FIG. 4 illustrates a top perspective view of an RCD seal 46 according to the present embodiments including radially inward facing sealing face 44, multiple seal guides 48, and the upper seal guide retainer 66. In the embodiment of FIG. 4, the RCD seal 46 is solitary (or continuous). In other embodiments, the RCD seal 46 may be segmented into 2, 3, 4, 5, 6, 7, 8, 9, 10, as well as other numbers of segments. In embodiments in which the RCD seal 46 is segmented, each segment may span an equal number of angular degrees such that the segments together span the full 360-degree circumferential spectrum surrounding an outer diameter of the drill pipe 12 (shown in FIGS. 1-3 and 7-10). In the embodiment of FIG. 4, the RCD seal 46 includes 6 seal guides 48. In other embodiments, 1, 2, 3, 4, 5, 7, 8, 9, 10 or other numbers of seal guides 48 may be disposed within the RCD seal 46. In the embodiment of FIG. 4, the upper seal guide retainer 66 includes a ring that may circumferentially surround the drill string 12 and may be disposed through each of the seal guides 48 as well as the RCD seal 46, to keep the seal guides 48 coupled to the RCD seal 46. The upper and lower seal guide retainers 66, 68 may be flexible such that they can expand to accommodate larger and smaller diameter drill strings 12. In other embodiments, the upper and lower seal guide retainers 66, 68 may include multiple segments that allow them to expand within the seal guides 48, again to accommodate larger and smaller diameter drill strings 12. In embodiments in which the RCD seal 46 includes multiple seal segments, each segment may include 1, 2, 3 or some other number of seal guides 48 disposed thereon.

Figure 5:
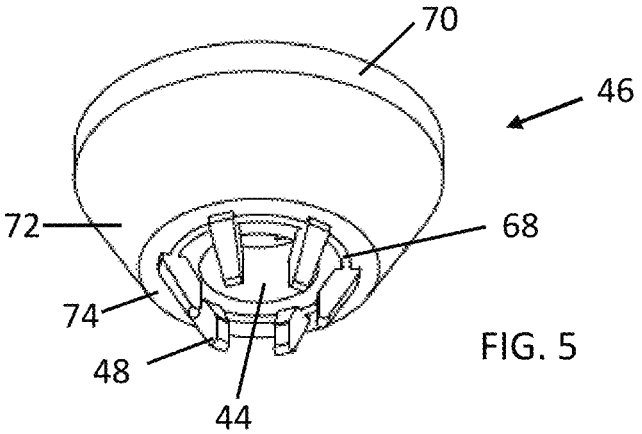
FIG. 5 illustrates a bottom perspective view of a rotating control device (RCD), in accordance with aspects of the present disclosed embodiments.

FIG. 5 illustrates a bottom perspective view of an RCD seal 46 according to the present embodiments including multiple seal guides 48, a lower seal guide retainer 68 in a ring configuration disposed through each of the seal guides 48, as well as an outer rim portion 70 that defines the maximum outer diameter of the RCD seal 46, and is aligned longitudinally such that it is concentric about a borehole or drill string 12 centerline (not shown). The RCD seal 46 may also include an angled portion 72 that angles radially inward as it transitions longitudinally downward toward a bottom face 74 that is oriented in a radial plane (that is, facing longitudinally downward). The lower seal guide retainer 68 may be coupled to the bottom face 74 of the RCD seal 46 via any suitable attachment including compression fit, epoxy, weld joint, braze joint, grooves disposed in the bottom face, glue, tape, cement, and other attachments. The RCD seal 46 may generally include a conical shape that truncates at the longitudinally downward bottom face 74 as well as at the radially outward outer rim portion 70. The sealing face 44 (which may directly contact the drill string 12, thereby forming a seal) is also visible in the embodiment of FIG. 5.

Figure 6:
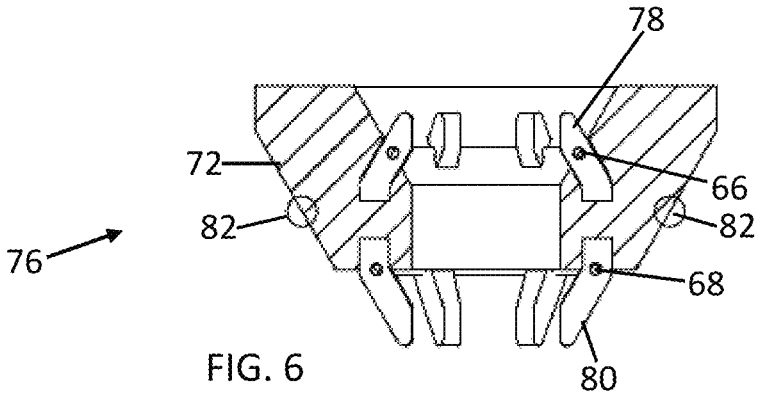
FIG. 6 illustrates a front view of an alternate embodiment of a rotating control device (RCD), in accordance with aspects of the present disclosed embodiments.

FIG. 6 illustrates a front view of an alternative RCD seal 76. The alternate RCD seal 76 may include seal guides that include two or more portions such that at each circumferential location around the alternative RCD seal 76, each seal guide includes an upper guide 78, and a lower guide 80. The upper guide 78 may be coupled to the alternative RCD seal 76 via the upper guide seal retainer 66 while the lower guide 80 may be coupled to the alternative RCD seal 76 via the lower guide seal retainer 68. One or more seal compression springs 82 may be disposed in the angled portion 72 of the alternative RCD seal 76. The one or more seal compression springs 82 may include one or more garter springs, as well as other types of springs and may be used to push the alternative RCD seal 76 radially inward such that it remains biased against the drill string 12. The one or more seal compression springs 82 may be disposed between the angled portion 72, and the radially outer walls of the annulus 52, 100 (shown in FIG. 2) such that they compress as the alternative RCD seal 76 moves radially outwardly as the outer diameter (or outer surface) of the drill string expands within the seal assembly 58, 60. Each of the seal compression springs 82 may remain compressed even as the smallest outer diameter portion of the drill string 12 is disposed within the seal assembly. The RCD seals 46 of FIGS. 1-5 and 7-10 may similarly include seal compression springs 82. In other embodiments, the one or more seal compression springs 82 may contact the RCD seal 46 only when larger diameter pipe segments are within (or passing through) the seal assembly 58, 60.

Referring still to FIG. 6, in some embodiments, the seal compression springs 82 may be disposed radially outside of the RCD Seal (6) such that they only engage with RCD seal 46 when a change of diameter in the drill string 12 is encountered. In some embodiments, only a single seal compression spring 82 may be needed while in other embodiments, it may be desirable to include more than one seal compression spring 82 on the RCD seal 46 or alternative RCD seal 76. In one or more aspects of the embodiment of FIG. 6, the upper guides 78 may engage with the drill string 12 only when the drill pipe tool joint 38 is passing vertically downward through the alternate RCD seal 76. Similarly, in one or more aspects of the embodiment of FIG. 6, the lower guides 80 may engage with the drill string 12 only when the drill pipe tool joint 38 is passing vertically upward through the alternate RCD seal 76. In one or embodiments, one or more linkages (not shown) may be used to couple at least one of the upper guides 78 to at least one of the lower guides 80 such that the guides 78, 80 and linkage act as a hinge that pushes the RCD seal 46 radially outward when a larger diameter pipe string in encountered, rather than the sealing face 44 pushing the RCD 46 seal outward. In one or more embodiments, the upper and lower seal assemblies 58, 60 may not include seal retainers 66, 68 and instead the seal guides 48 may be bonded directly to the RCD seals 46. In other embodiments, the seal guides 48 may be fabricated or manufactured as integral components or features of the RCD seal 46, rather than as separate components. In other embodiments, the seal guides 48 may include a "T" shape, where the top part of the "T" is embedded into the RCD seal 46 during manufacturing, thereby allowing the seal guide 48 to rotate about the top part of the T, or alternatively, to be held rigidly within the RCD seal 46. As such, the upper and lower seal retainers 66, 68 may act as backups in the event the bond between the seal guides 48 and the RCD seal 46 breaks, thereby preventing the seal guides 48 from dropping into the borehole.

Figure 7:
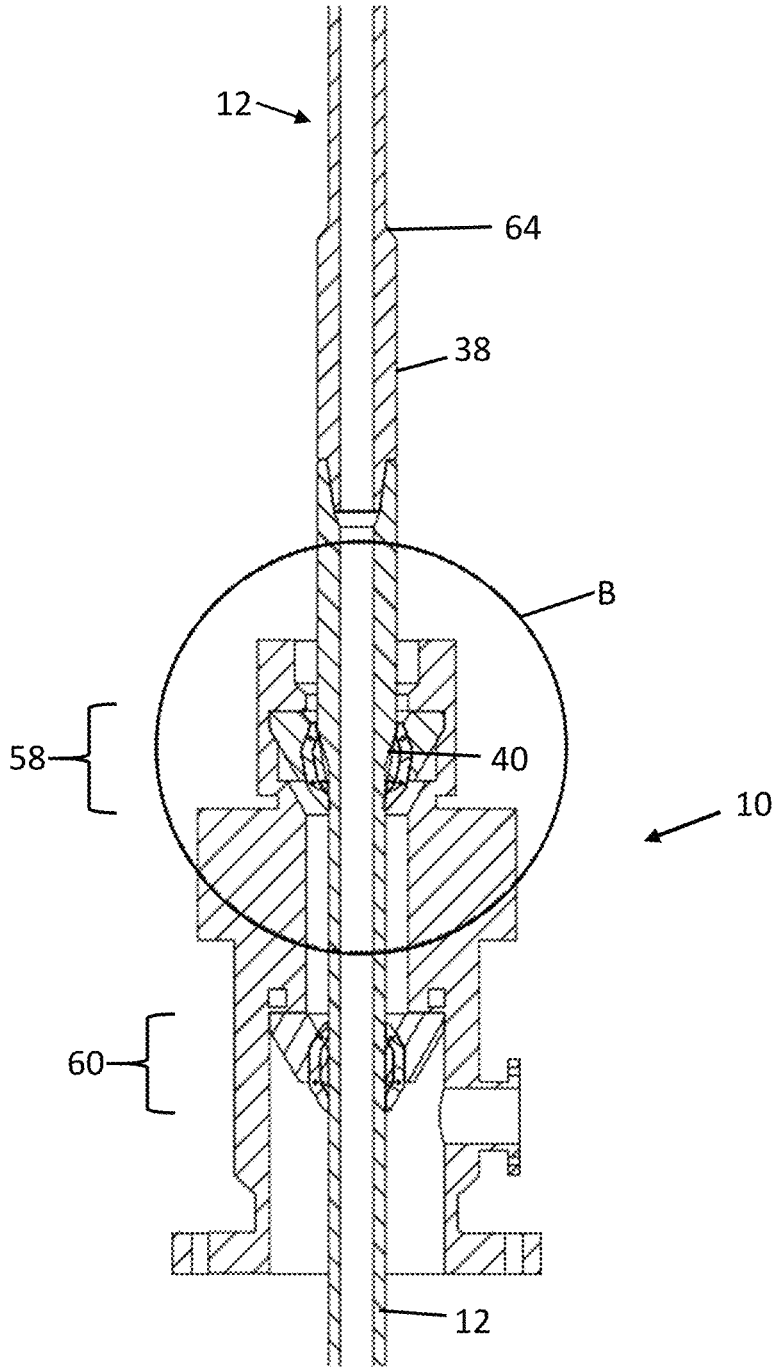
FIG. 7 illustrates a rotating control device (RCD), in accordance with aspects of the present disclosed embodiments.

FIG. 7 illustrates a rotating control device (RCD) 10 including a drill string 12 disposed within it. In the embodiment of FIG. 7, a leading edge 40 of the drill pipe tool joint 38 is disposed radially within the upper seal assembly 58 while the drill pipe 12 is disposed radially within the lower seal assembly 60. The trailing edge 64 of the drill pipe tool joint 38 is not disposed within the RCD 10 and is instead located above the RCD 10. In the embodiment of FIG. 3, the trailing edge 64 is disposed within the lower seal assembly 60, while in the embodiment of FIG. 7, the leading edge 40 is disposed within the upper seal assembly 58.

Figure 8:
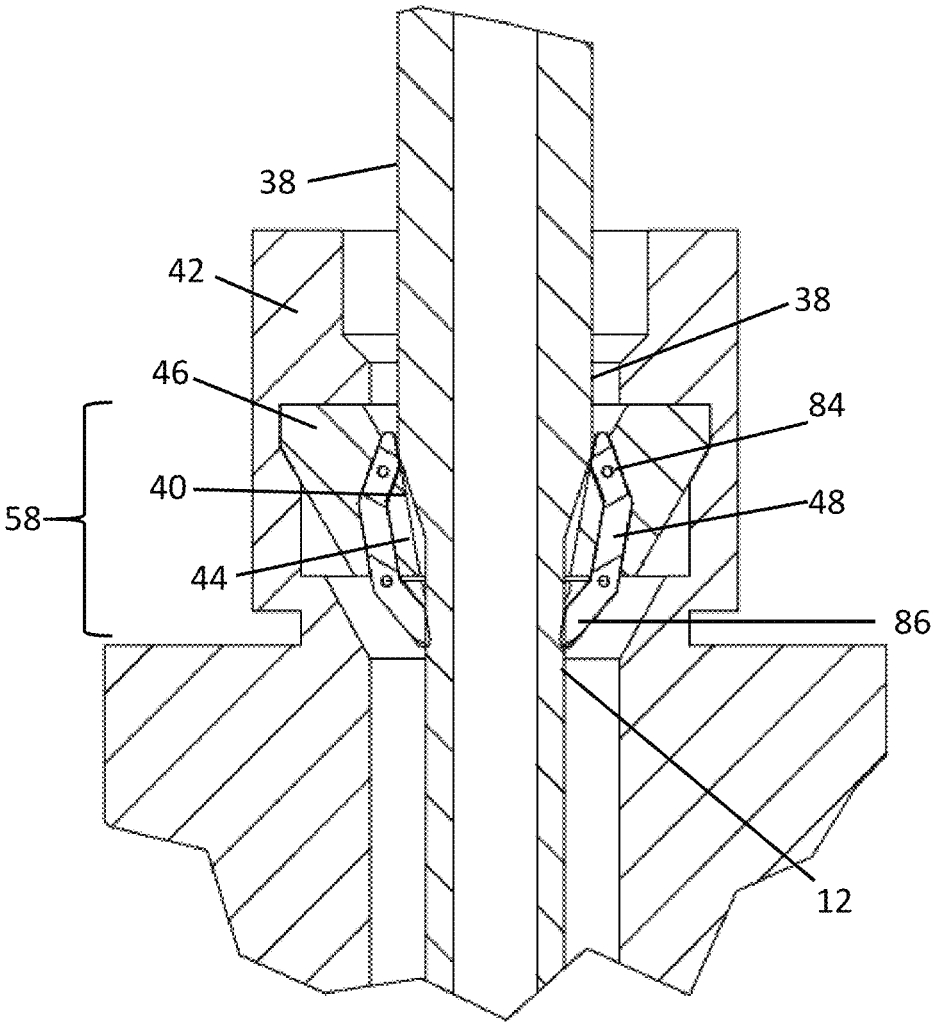
FIG. 8 illustrates an enlarged view of a rotating control device (RCD), in accordance with aspects of the present disclosed embodiments.

FIG. 8 illustrates an enlarged view of the portion of the RCD 10 including portions of the RCD housing 42 disposed within the circle marked B in FIG. 7. In the embodiment of FIG. 8, the drill pipe tool joint 38 is disposed above the upper seal assembly 58 while the portion of the drill pipe 12 with a smaller diameter is disposed below the upper seal assembly 58. The leading edge 40 is disposed radially within the upper seal assembly 58. Each seal guide 48 may include a guide top portion 84 as well as a guide bottom portion 86. In the embodiment of FIG. 8, both the guide top portion 84 and the top of the sealing face 44 are in contact with the drill pipe tool joint 38 (larger diameter) while both the guide bottom portion 86 and the bottom of the sealing face 44 are in contact with the drill pipe 12 (smaller diameter). As such, the upper seal assembly 58 is able to simultaneously cause the sealing face 44 and seal guides to remain in contact with the drill string 12 at portions of the drill string 12 that include two (2) different diameters. Therefore, while drill pipe tool joints 38 move down through the rotating control device (RCD) 10, and back up through the RCD 10, the RCD seal 46 of the present embodiments is able to maintain sealing, without risking damaging the RCD seal 46.

Figure 9:
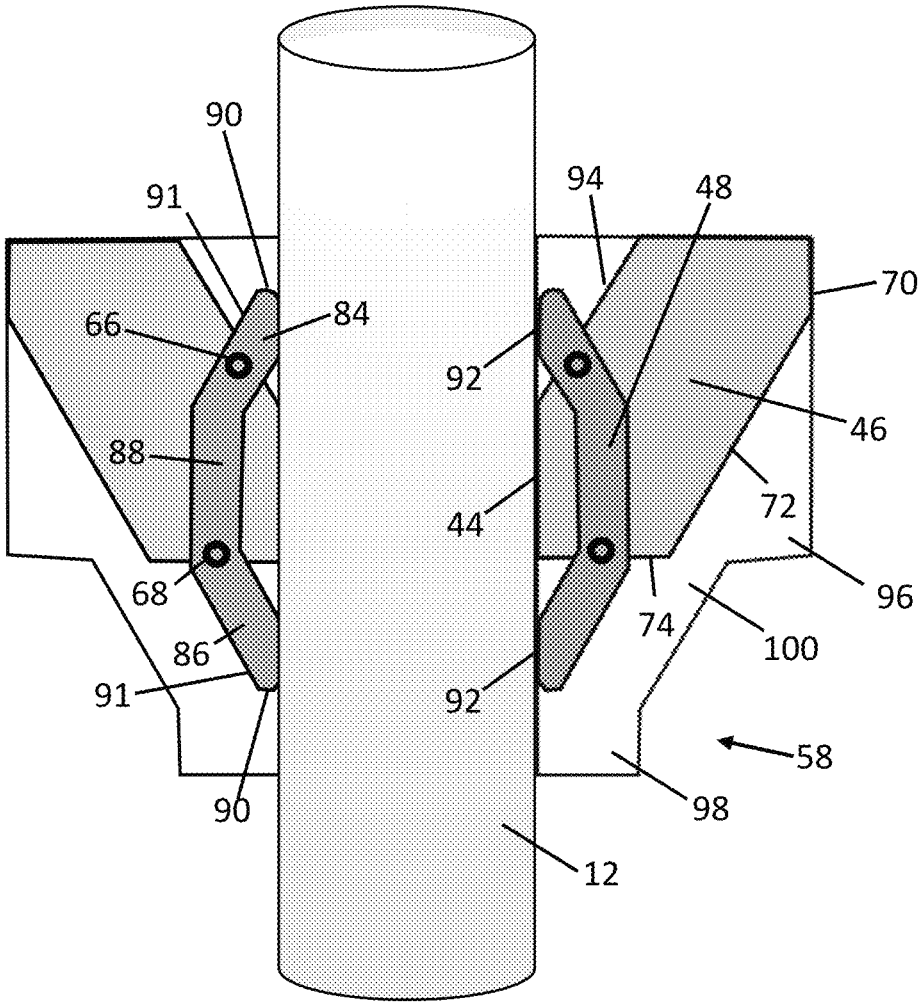
FIG. 9 illustrates an enlarged view of a rotating control device (RCD), in accordance with aspects of the present disclosed embodiments.

FIG. 9 illustrates an enlarged view of the upper seal assembly 58 including a drill pipe 12 disposed between the sealing faces 44 of the RCD seal 46. In the embodiment of FIG. 9, each of the seal guides 48 may include a guide middle portion 88 disposed between the guide top portion 84 and the guide bottom portion 86. The guide middle portion 88 may be aligned in a longitudinal direction (+/−5 degrees, or in other embodiments, +/−10-15 degrees) and may be longer in length than each of the guide top portion 84 and the guide bottom portion 86. The guide top portion 84 may be aligned at an angle of about 29 degrees from the longitudinal direction, or in other embodiments from about 24 degrees to about 34 degrees from the longitudinal direction. In other embodiments, the guide top portion 84 may be aligned from about 19 degrees to about 39 degrees from the longitudinal direction. The guide bottom portion 86 may be aligned at an angle of about 32 degrees from the longitudinal direction, or in other embodiments from about 27 degrees to about 37 degrees from the longitudinal direction. In other embodiments, the guide bottom portion 86 may be aligned from about 22 degrees to about 42 degrees from the longitudinal direction. Each of the seal guides 48 may include a contoured face 92 disposed in either or both of the guide top portion 84 and the guide bottom portion 86. The contoured faces 92 may be aligned in the longitudinal direction and contoured to approximately conform with the outer diameter (or outer surface) of the drill pipe 12 or drill pipe tool joint 38.

Referring still to FIG. 9, the seal guides 48 may also include a rounded edge 90 at the transition between the contoured face 92 and the radially outer portions 91 of each of the guide top portion 84 and the guide bottom portion 86. The upper and lower guide seal retainers 66, 68 may be disposed roughly in the middle of each of the guide top and bottom portions 84, 86 (for example, in the location that the upper guide seal retainer 66 is disposed within the guide top portion 84 in the embodiment of FIG. 9). In other embodiments, the upper and lower guide seal retainers 66, 68 may be disposed roughly at the intersection with the guide middle portion 88 (for example, in the location that the lower guide seal retainer 68 is disposed within the seal guide 48 in the embodiment of FIG. 9). The angled portion 72 of the RCD seal 46, as well as an opposing inner angled portion 94, may each be oriented at an angle of about 30 degrees from the longitudinal direction, or from about 30 degrees to about 40 degrees, or in other embodiments, from about 25 degrees to about 45 degrees from the longitudinal direction. An annulus 100 or fluid return flow-path may be disposed around the upper seal assembly 58 and may include an expanded portion 96 proximate the RCD seal 46 allowing the RCD seal 46 to expand. The annulus 100 may also include a narrow portion 98. The narrow portion 98 has a smaller inner diameter than the expanded portion 100, but has a larger inner diameter than the outer diameter of drill pipes 12 disposed within the upper seal assembly 58 such that when drill pipe tool joints 38 are pushed through the upper seal assembly 58, there is space within the narrow portion 98 for them to pass. In one embodiment, the narrow portion 98 may have an inner diameter from about 50% to about 60% greater than the outer diameter of the drill pipe 12, or from about 45% to about 65% greater than the outer diameter of the drill pipe 12. The expanded portion 96 may include an inner diameter that is from about 55% to about 60% greater than the inner diameter of the narrow portion 98 and in other embodiments, the expanded portion 96 may include an inner diameter that is from about 50% to about 65% greater than the inner diameter of the narrow portion 98.

Figure 10:
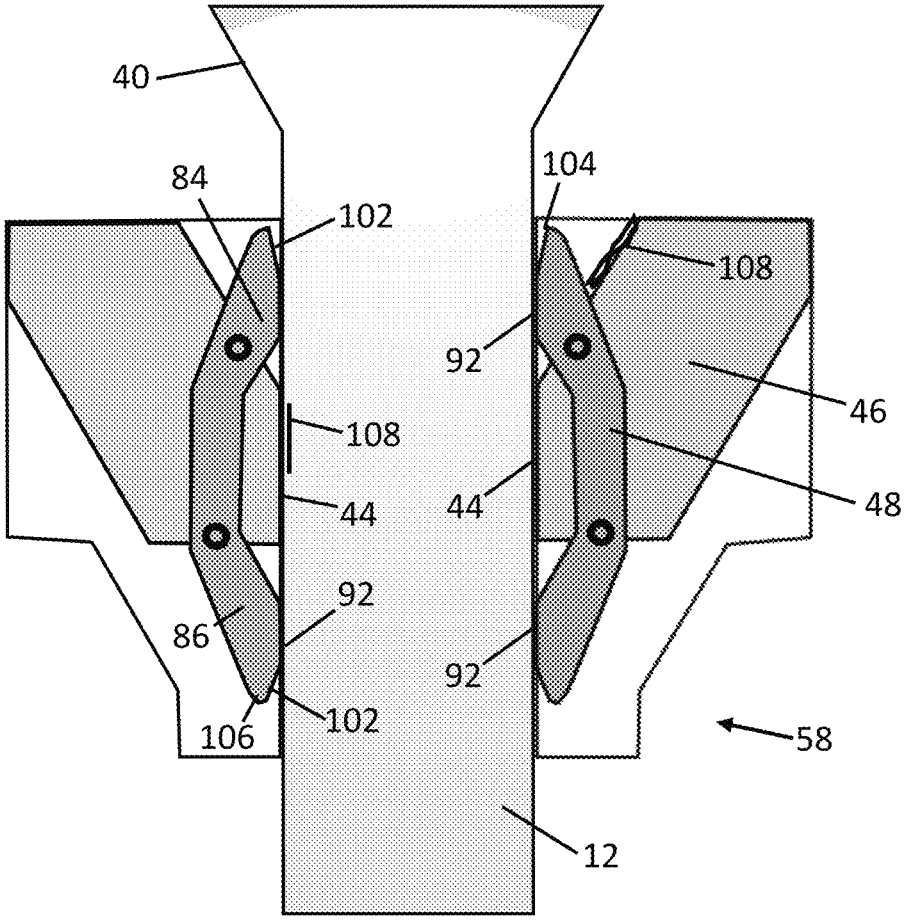
FIG. 10 illustrates an enlarged view of a rotating control device (RCD), in accordance with aspects of the present disclosed embodiments.

FIG. 10 illustrates an enlarged view of the upper seal assembly 58 including a drill pipe 12 disposed between the sealing faces 44 of the RCD seal 46. In the embodiment of FIG. 10, each of the seal guides 48 may include one or more lip portions 102 adjacent the contoured faces 92 disposed in each of the guide top and bottom portions 84, 86. The seal guides 48 may also include a single point 104 that defines the edge of the lip portions 102. In other embodiments, the seal guides 48 may include a rounded portion 106 defining the edge of each lip portion 102. The lip portions 102 may be oriented at an angle of about 20 degrees or from about 15 degrees to about 25 degrees, or from about 10 degrees to about 30 degrees from the longitudinal direction. In one or more embodiments, the lips 102 may be oriented at a steeper angle (that is, at a lower degree or smaller angle from the longitudinal direction) than the angle of the leading edge 40 or trailing edge 64 of the drill pipe tool joint 38 (the angles of the leading edge 40 and the trailing edge 64 being defined with respect to the longitudinal direction). In operation, the lip 102 may catch (or come in contact with) the leading edge 40 or trailing edge 64 and may begin to pre-open the RCD seal 46 as the drill pipe tool joint 38 transitions through the upper seal assembly 58.

Each of the seal guides 48 may be embedded into the RCD seal 46 and may be composed of a harder material than the RCD seal 46. In one or more embodiments, the seal guides 48 may be disposed on the outside of the RCD seal 46 (for example, on the angled portion 72 of the RCD seal 46). In such embodiments, the seal guides 48 may extend longitudinally above and below the RCD seal 46 (and sealing face 44) such that they engage larger diameter portions of the drill string 12 prior to those larger portions reaching the RCD seal 46. When changes in diameter are encountered, the seal guides 48 may mechanically push the RCD seal radially outward (or allow it to move radially inward in cases where the diameter is decreasing). In other embodiments, the seal guides 48 may act as "feeler gauges," thereby sensing portions of the drill string 12 where the diameter is changing, and sending a signal to engage an external actuator (for example, a hydraulic piston or electromechanical device) that will move the RCD seal 46 as required. In one or more embodiments, a hard coating layer 108 (shown in FIG. 10) may be introduced onto various surfaces of the RCD seal 46 (for example, the outer rim 70, the angled portion 72, the bottom face 74, as well as the sealing faces 44). The hard coating layer 108 may act similar to the seal guides 48 such that one or more hard-facing (or harder material) coatings may be applied to the surfaces of the RCD seal 46 to allow the portion of the drill string 12 with changing diameters to more easily slide across the surfaces of the RCD seal 46. The hard coating layers 108 may be applied in such a way that it expands or gradually increases (or decreases) in thickness so that it biases the RCD seal 46 radially inward or outward as the drill string 12 slides across it. In one embodiment, multiple thin long strips of hard coating layers 108 may be disposed across leading edges of the RCD seal 46. For example, from about 10 strips and about 30 or about 40 strips of hard coating layers 108 may be applied to circumferentially cover 360 degrees.

The RCD seal 46 of the present embodiments may be designed such that the RCD seal 46 experiences no loss of pressure as the tool joint 38 or other larger diameter tubular or object is moved through the RCD seal 46. For example, in most scenarios, at least one of the guide top portion 84 and the guide bottom portion 86 will remain in contact with the drill string 12 (along with portions of the sealing face 44) even as the objects with varying diameter are brought through the RCD seal 46. The system may also be designed to allow for a temporary or relatively minor pressure release to occur, for example when tubulars with a lip or step change in diameter are passing through. In such cases, the guide middle portion 88 may come into contact with the tubular lip, thereby minimizing the annular gap and loss of pressure. The RCD seal 46 may be manufactured from an expandable material (that is, more flexible than typical drill pipes 12 or tubulars) with a smaller inner diameter than the outer diameter of the drill pipe 12 such that the RCD seal 12 maintains a tight seal around the drill string 12, even in the absence of a seal compression spring 82.

Rotating control devices 10, RCD seals 46, and seal assemblies 58, 60 according to the present disclosed embodiments may be interchangeable with currently-available seals and RCDs. In some embodiments, it may be desirable to machine, manufacture, or fabricate an RCD housing 42 that allows for the placement and movement of the seal guides 48, RCD seals 46, and other accompanying structures disclosed herein, within the RCD housing 42. The RCD seal 46 and accompanying assembly 58, 60 of the present embodiments may be installed, removed and replaced in similar fashion to what is currently done.

In operation, the seal guides 48 may track the outer diameter (or outer surface) of the drill string 12 without requiring any operator intervention. In some embodiments an operator may act or intervene when different diameter drill pipe 12 sections are passing through the RCD seal 46 and are sensed by the seal guides 48. Such action may include pressing a button to cause the seal guides 46 to engage the RCD seal 46 to pre-expand before the larger diameter pipe passes through. Proximity probes, touch sensors, feeler gauges, levers, linkages, and other sensors and instrumentation may be used to detect the presence of larger (or smaller) diameter pipes, and also, in some embodiments, to measure such diameters, as well as the longitudinal distance from the RCD seal 46 (which may aid in determining the precise instance when the RCD seal 46 should be pre-opened). The information can then be passed along to allow the upper and lower seal assemblies 58, 60 to pre-expand the RCD seal 46 as required via one or more hydraulic pistons, electromechanical devices, expandable sleeves, wedges (for example spring-activated wedges between the RCD seal 46 and drill pipe 12 that may be used to pre-expand the RCD seal 46, and then re-seal it upon retraction of the spring after the large diameter pipe has passed through), as well as other actuators.

The rotating control device 10 of the present disclosed embodiments, including upper and lower seal assemblies 58, 60 with one or more seal guides 48 disposed on the RCD seal 46 and extending longitudinally below and above the sealing faces 44, may allow for better control of the expansion of the RCD seal 46 when larger drill pipe 12 sections are passing through the seal. Pre-opening the RCD seal 46 reduces the stress internal to the seal and reduces the likelihood of seal elements becoming sliced or receiving tong marks, or other forms of damage. By replacing existing seals with RCD seals 46 of the present embodiments that include seal guides 48 that will track the outer diameter (or outer surface) of drill pipes 12 to pre-expand RCD seals 46 for larger diameter sections, increases in seal reliability, as well as reductions in non-productive time due to RCD seal 46 failures may be realized. The friction between the RCD seal 46 and the drill string 12 may also be reduced as a result of pre-expanding the RCD seal 46, as large diameter drill pipe 12 portions pass through. The present disclosed RCD 10 and components thereof may be used in connection with conventional drilling equipment, and in many cases, systems and components described herein may fit within existing equipment, thereby eliminating the need to modify systems currently in use.

Each of the instruments, devices, and sensors described in the present disclosure may include a wired power supply or a wireless power supply such as a battery, capacitor, or other suitable mechanism.

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

These and other features, aspects and advantages of the present invention will become better understood with reference to the following description and appended claims. The accompanying drawings, which are incorporated in and constitute a part of this specification, illustrate embodiments of the present disclosure and, together with the description, serve to explain the principles of the present embodiments.

Certain Definitions

In order for the present disclosure to be more readily understood, certain terms are first defined below. Additional definitions for the following terms and other terms are set forth throughout the specification.

An apparatus, system, or method described herein as "comprising" one or more named elements or steps is open-ended, meaning that the named elements or steps are essential, but other elements or steps may be added within the scope of the system, apparatus, or method. To avoid prolixity, it is also understood that any apparatus, system, or method described as "comprising" (or which "comprises") one or more named elements or steps also describes the corresponding, more limited apparatus or method "consisting essentially of" (or which "consists essentially of") the same named elements or steps, meaning that the apparatus or method includes the named essential elements or steps and may also include additional elements or steps that do not materially affect the basic and novel characteristic(s) of the apparatus or method. It is also understood that any apparatus, system or method described herein as "comprising" or "consisting essentially of" one or more named elements or steps also describes the corresponding, more limited, and closed-ended apparatus or method "consisting of" (or "consists of") the named elements or steps to the exclusion of any other unnamed element or step. In any apparatus, system, or method disclosed herein, known or disclosed equivalents of any named essential element or step may be substituted for that element or step.

As used herein, "a" or "an" with reference to a claim feature means "one or more," or "at least one."

As used herein, the term "longitudinally" generally refers to the vertical direction, and may also refer to directions that are co-linear with or parallel to the centerlines of the drill string, and the borehole. Angles that are defined relative to a longitudinal direction may include both negative and positive angles. For example, a 30-degree angle relative to the longitudinal direction may include both an angle that is rotated clockwise 30 degrees from the vertical direction (that is, a positive 30-degree angle) as well as an angle that is rotated counterclockwise 30 degrees from the vertical direction (that is, a negative 30-degree angle).

As used herein, the term "substantially" refers to the qualitative condition of exhibiting total or near-total extent or degree of a characteristic or property of interest.

EQUIVALENTS

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A seal assembly comprising:

a rotating control device (RCD) seal comprising a sealing face for interfacing with a drill string, the sealing face concavely contoured and extending longitudinally, the sealing face sealing an annulus of a borehole; and a seal guide coupled to the RCD seal, the seal guide extending both longitudinally above and longitudinally below the sealing face, the seal guide comprising:

a guide middle portion oriented in a longitudinal direction;

a guide top portion extending longitudinally upward from the guide middle portion; and a guide bottom portion extending longitudinally downward from the guide middle portion, where the seal guide causes the RCD seal to move at least one of radially inward and radially outward, upon making contact with one or more portions of the drill string, the one or more portions comprising a changing outer diameter, and where at least one of the guide top portion and the guide bottom portion comprises a contoured face for interfacing with the drill string.

2. The assembly of claim 1, where the one or more portions of the drill string comprises a leading edge of a drill pipe tool joint, or a trailing edge of a drill pipe tool joint, and where the RCD seal comprises an angled portion that angles radially inward as it transitions longitudinally downward toward a bottom face of the RCD seal, the bottom face oriented in a radial plane.

3. The assembly of claim 1, further comprising a guide seal retainer coupling the seal guide to the RCD seal.

4. The assembly of claim 3, where the guide seal retainer comprises an upper guide seal retainer and a lower guide seal retainer, where each of the upper guide seal retainer and the lower guide seal retainer comprises a flexible, ring-shaped retainer circumferentially disposed within an interior of the RCD seal, and disposed through the seal guide, and where each of the upper guide seal retainer and the lower guide seal retainer comprises at least one of a pin, a tack, an axis, a dowel, a rod, a screw, a rivet, a weld joint, a braze joint, a magnet, a compression joint, a locking mechanism, a tongue and groove assembly, a dovetail, a tang, and a slot for coupling the respective upper guide seal retainer and the lower guide seal retainer to the RCD seal.

5. The assembly of claim 1, where the guide top portion is oriented at an angle from about 19 degrees to about 39 degrees relative to the longitudinal direction, and the guide bottom portion is oriented at an angle from about 22 degrees to about 42 degrees relative to the longitudinal direction.

6. The assembly of claim 1, where at least one of the guide top portion and the guide bottom portion comprises a rounded edge defining a transition between the contoured face and a radially outer portion of at least one of the guide top portion and the guide bottom portion.

7. The assembly of claim 1, where at least one of the guide top portion and the guide bottom portion comprises a lip for the interfacing with at least one of a leading edge and a trailing edge of the drill string.

8. The assembly of claim 7, where the lip is oriented at an angle from about 10 degrees to about 30 degrees relative to the longitudinal direction.

9. The assembly of claim 8, where the guide top portion is oriented at an angle from about 19 degrees to about 39 degrees relative to the longitudinal direction, the guide bottom portion is oriented at an angle from about 22 degrees to about 42 degrees relative to the longitudinal direction, the guide middle portion is longer than each of the guide top portion and the guide bottom portion, and at least one of the guide top portion and the guide bottom portion comprises a contoured face for interfacing with the drill string.

10. The assembly of claim 1, further comprising a hard coating disposed on the sealing face of the RCD seal, where the hard coating comprises from about 10 to about 40 thin long strips of hard coating layers disposed across leading edges of the RCD seal thereby circumferentially covering 360 degrees of the RCD seal.

11. The assembly of claim 1, where the RCD seal comprises multiple-segments circumferentially spaced around an outer diameter of the drill string, and where each segment of the multiple segments spans an equal number of angular degrees such that the multiple segments together span the full 360-degree circumference surrounding an outer diameter of the drill string.

12. The assembly of claim 1, where the seal guide further comprises:

at least one upper guide extending longitudinally above the sealing face; and at least one lower guide extending longitudinally below the sealing face, where the assembly is part of a rotating control device (RCD) that is secured to an annular blow-out preventer (BOP) via one or more dowels and one or more blind holes disposed within the BOP, the one or more dowels coupling a bottom surface of the RCD to a top surface of the annular blow-out preventer, and where the dowel circumferentially aligns the RCD with the annular blow-out preventer.

13. The assembly of claim 1, where the seal guide causes the RCD seal to move radially outward upon contacting a portion of the drill string which comprises a widening of its outer diameter, and where the seal guide causes the RCD seal to move radially inward upon contacting a portion of the drill string which comprises a narrowing of its outer diameter.

14. The assembly of claim 4, where the guide top portion is oriented at an angle from about 19 degrees to about 39 degrees relative to the longitudinal direction.

15. The assembly of claim 4, where the guide bottom portion is oriented at an angle from about 22 degrees to about 42 degrees relative to the longitudinal direction.

16. A seal assembly comprising:

a rotating control device (RCD) housing comprising a hinge;

an RCD seal segment disposed within the RCD housing and rotatably coupled to the hinge, the RCD seal segment comprising a sealing face for interfacing with a drill string; and a seal guide coupled to the RCD seal segment, where the seal guide and the RCD seal segment rotate about the hinge when the seal guide is contacted by an outer surface of the drill string, where the seal guide further comprises;

at least one upper guide extending longitudinally above the sealing face; and at least one lower guide extending longitudinally below the sealing face, where the assembly is part of a rotating control device (RCD) that is secured to an annular blow-out preventer (BOP) via one or more dowels and one or more blind holes disposed within the BOP, the one or more dowels coupling a bottom surface of the RCD to a top surface of the annular blow-out preventer, and where the dowel circumferentially aligns the RCD with the annular blow-out preventer.

17. A rotating control device (RCD) comprising an upper seal assembly comprising:

a rotating control device (RCD) seal comprising sealing face for interfacing with a drill string, the sealing face concavely contoured and extending longitudinally, the sealing face sealing an annulus of a borehole; and a seal guide coupled to the RCD seal, the seal guide extending both longitudinally above and longitudinally below the sealing face, the seal guide comprising:

a guide middle portion oriented in a longitudinal direction;

a guide top portion extending longitudinally upward from the guide middle portion; and a guide bottom portion extending longitudinally downward from the guide middle portion, where the seal guide causes the RCD seal to move radially outward upon contacting a portion of the drill string comprising a widening outer diameter, where the seal guide causes the RCD seal to move radially inwardly upon contacting a portion of the drill string comprising a narrowing outer diameter, where the guide top portion is oriented at an angle from about 19 degrees to about 39 degrees relative to the longitudinal direction, and where the guide bottom portion is oriented at an angle from about 22 degrees to about 42 degrees relative to the longitudinal direction.

18. The device of claim 17, further comprising:

a lower seal assembly disposed longitudinally below the upper seal assembly, where the RCD provides redundant sealing such that at least one of the upper seal assembly and the lower seal assembly is always sealed even while objects are moving through the RCD seal.

19. The device of claim 18, further comprising:

an RCD housing for housing the upper seal assembly and the lower seal assembly;

an annulus defined by a space radially outward of the drill string and radially inward of the RCD housing; and a pipe connection fluidly connecting the annulus to an RCD buffer manifold, where the pipe connection and RCD buffer manifold provide a transition between the annulus and a downstream managed pressure drilling (MPD) system.

20. The assembly of claim 16, where the seal guide makes direct contact with the outer surface of the drill string.

21. The assembly of claim 20, further comprising an upper seal assembly and a lower seal assembly, where the outer surface of the drill string comprises a drill pipe tool joint leading edge, where the drill pipe tool joint leading edge is disposed radially within an upper seal assembly, and where the drill string is disposed radially within the lower seal assembly.

22. The assembly of claim 20, further comprising a seal compression spring disposed in the RCD seal segment, the seal compression spring biasing the RCD seal segment against the drill string, where the seal compression spring comprises one or more garter springs.

* * * * *